US005563110A

United States Patent [19]

Asajima et al.

[11] Patent Number: 5,563,110

[45] Date of Patent: Oct. 8, 1996

[54] THERMAL TRANSFER IMAGE-RECEIVING SHEET

[75] Inventors: Mikio Asajima; Takeshi Ueno; Katsuyuki Oshima; Hidetake Takahara; Mineo Yamauchi, all of Tokyo, Japan

[73] Assignee: Dai Nippon Printing Co., Ltd., Japan

[21] Appl. No.: 378,570

[22] Filed: Jan. 26, 1995

Related U.S. Application Data

[62] Division of Ser. No. 983,168, Nov. 30, 1992, Pat. No. 5,418,207.

[30] Foreign Application Priority Data

| | | | |
|---|---|---|---|
| Nov. 29, 1991 | [JP] | Japan | 3-339444 |
| Feb. 20, 1992 | [JP] | Japan | 4-69403 |
| Mar. 13, 1992 | [JP] | Japan | 4-88267 |
| Apr. 6, 1992 | [JP] | Japan | 4-112461 |

[51] Int. Cl.[6] ..... B41M 5/035; B41M 5/38

[52] U.S. Cl. ..... 503/227; 428/195; 428/304.4; 428/913; 428/914

[58] Field of Search ..... 8/471; 428/195, 428/913, 914, 304.4; 503/227

[56] References Cited

U.S. PATENT DOCUMENTS

| | | | |
|---|---|---|---|
| 4,837,200 | 6/1989 | Kondo et al. | 503/227 |
| 5,071,823 | 12/1991 | Matsushita et al. | 503/227 |

FOREIGN PATENT DOCUMENTS

| | | | |
|---|---|---|---|
| 61-270192 | of 0000 | Japan | 503/227 |

OTHER PUBLICATIONS

Database Paperchem, No. 60–10695, K. Maruta et al. (May 1,1989).

*Primary Examiner*—Bruce H. Hess

*Attorney, Agent, or Firm*—Parkhurst, Wendel & Burr, L.L.P.

[57] ABSTRACT

A receiving layer transfer sheet comprising a substrate sheet and a transferable resin layer provided on one surface of the substrate sheet, wherein said transferable resin layer comprises a dye-receiving layer and a cell-containing layer and said cell-containing layer contains a cell and/or a foaming agent capable of increasing the thickness of the transferable resin layer by a factor of 1.1 to 4 upon being heated; and a thermal transfer image-receiving sheet comprising a substrate sheet and a resin layer provided on one surface of the substrate sheet, wherein said resin layer comprises a dye-receiving layer and a cell-containing layer and said cell-containing layer contains a cell and/or a foaming agent capable of increasing the thickness of the transferable resin layer by a factor of 1.1 to 4 upon being heated.

A receiving layer transfer sheet comprising a substrate sheet and a transferable resin layer provided on one surface of the substrate sheet, wherein said transferable resin layer comprises a dye-receiving layer and a cell-containing layer and said cell-containing layer comprises a cell and/or a foaming agent having an average particle diameter of 20 μm or less; and a thermal transfer image-receiving sheet comprising a substrate sheet and a resin layer provided on one surface of the substrate sheet, wherein said resin layer comprises a dye-receiving layer and a cell-containing layer and said cell-containing layer comprises a cell and/or a foaming agent having an average particle diameter of 40 μm or less.

20 Claims, 1 Drawing Sheet

THERMAL TRANSFER IMAGE-RECEIVING SHEET

This is a division of application Ser. No. 07/983,168 filed Nov. 30, 1992, now U.S. Pat. No. 5,418,207.

BACKGROUND OF THE INVENTION

The present invention relates to a thermal transfer image-receiving sheet and a process for producing the same. More particularly, the present invention is concerned with a thermal transfer image-receiving sheet capable of forming a high-quality image free from defects such as dropout and omission of dots on any transfer material.

Various thermal transfer processes are known in the art. One of them is a transfer process which comprises supporting a sublimable dye as a recording agent on a substrate sheet, such as paper or a polyester film, to form a thermal transfer sheet and forming various full color images on the transfer material, such as paper or a plastic film, provided with the dye-receiving layer. In this case, a thermal head of a printer is used as heating means, and a number of color dots of three or four colors are transferred to the transfer material, thereby reproducing a full color image of an original by the multicolor dots.

Since the color material used is a dye, the image thus formed is very sharp and highly transparent, so that the resultant image is excellent in the reproducibility and gradation and the quality of the image is the same as that of an image formed by the conventional offset printing and gravure printing. Further, according to this method, it is possible to form an image having a high quality comparable to a full color photographic image.

The above-described method, however, has a drawback that since the transfer material on which an image can be formed is limited to a plastic sheet dyeable with a dye, a paper provided with a dye-receiving layer previously formed thereon or other material, an image cannot be directly formed on general plain paper. It is a matter of course that an image can be formed even on general plain paper when a dye-receiving layer is previously formed on the surface of the paper. This, however, leads to an increase in the cost and is difficult to apply to general existing transfer materials, for example, post cards, paper for memorandum, letter paper, paper for a report, etc.

In order to solve the above-described problem, a proposal has been made on a receiving layer transfer sheet for simply forming a dye-receiving layer only in a necessary portion when an image is formed on a commercially available existing transfer material such as plain paper (see, for example, Japanese Patent Laid-Open Publication No. 264994/1987).

The use of the above-described receiving layer transfer sheet gives rise to no significant problem when the paper is a converted paper having a smooth surface. On the other hand, in the case of plain paper having a rough surface, a postcard and other paper, since a fiber is exposed on the surface and deteriorates the surface smoothness, the transfer of the receiving layer cannot be homogeneously conducted, which gives rise to occurrence of dropout or omission of a dot in the image formed on the receiving layer, so that a high-quality image cannot be formed.

The transfer of a receiving layer having an increased thickness is considered useful as a method for solving the above-described problems. In this case, however, the transferability and peelability of the receiving layer are poor.

Further, since the receiving layer is relatively hard, no satisfactory cushioning property can be attained. These cause the thermal migration from a thermal head through a thermal transfer sheet to become heterogeneous, so that no high-quality image can be formed. Further, there is a problem that since the heat conveyed to the receiving layer is liable to diffuse, the energy efficiency is unfavorably low.

Accordingly, an object of the present invention is to solve the above-described problem and to provide a thermal transfer image-receiving sheet which enables a high-quality and high-density image free from dropout and omission to be formed with a good thermal energy efficiency even on a rough paper not having a smooth surface.

SUMMARY OF THE INVENTION

The abovedescribed object can be attained by the following present invention.

A first embodiment of the invention provides a thermal transfer image-receiving sheet comprising a substrate and, formed on one surface of the substrate sheet, a resin layer comprising at least a dye-receiving layer, wherein said resin layer contains a hollow capsule having a volumetric hollowness of 50% or more; a process for producing a thermal transfer image-receiving sheet, wherein a resin layer comprising at least a dye-receiving layer and including a hollow capsule having a volumetric hollowness of 50% or more is provided on a substrate sheet by transferring; and a process for producing a thermal transfer image-receiving sheet, wherein a resin layer comprising at least a dye-receiving layer and including a hollow capsule having a volumetric hollowness of 50% or more is provided on a substrate sheet by coating.

The inclusion of a hollow capsule having a volumetric hollowness of 50% or more in a resin layer comprising at least a dye-receiving layer can impart good cushioning property and insulating property to the dye-receiving layer, which enables a high-quality of a dot and high-density image free from dropout and omission of a dot to be formed with a good thermal energy efficiency.

A second embodiment of the invention provides a receiving layer transfer sheet comprising a substrate sheet and a transferable resin layer provided on one surface of the substrate sheet, wherein said transferable resin layer comprises a dye-receiving layer and a cell-containing layer (hereinafter often referred to as "foaming-agent-containing layer") and said cell-containing layer contains a cell and/or a foaming agent capable of increasing the thickness of the transferable resin layer by a factor of 1.1 to 4 upon being heated; a thermal transfer image-receiving sheet comprising a substrate sheet and a resin layer provided on one surface of the substrate sheet, wherein said resin layer comprises a dye-receiving layer and a cell-containing layer and said cell-containing layer contains a cell and/or a foaming agent capable of increasing the thickness of the transferable resin layer by a factor of 1.1 to 4 upon being heated; and a process for producing a thermal transfer image-receiving sheet, wherein the transferable resin layer in said receiving layer transfer sheet is transferred to a substrate sheet.

When a cell and/or a foaming agent capable of increasing the thickness of the transferable resin layer by a factor of 1.1 to 4 upon being heated is included in the cell-containing layer, it becomes possible to provide a receiving layer transfer sheet and a thermal transfer image-receiving sheet which enable a high-quality and high-density image free from dropout and omission to be formed even on a rough paper or other paper not having a smooth surface.

A third embodiment of the invention comprises a receiving layer transfer sheet comprising a substrate sheet and a transferable resin layer provided on one surface of the substrate sheet, wherein said transferable resin layer comprises a dye-receiving layer and a foaming-agent-containing layer and said foaming-agent-containing layer contains at least two foaming agents different from each other in the foaming temperature; a thermal transfer image-receiving sheet comprising a substrate sheet and a resin layer provided on one surface of the substrate sheet, wherein said resin layer comprises a dye-receiving layer and a foaming-agent-containing layer and said foaming-agent-containing layer contains at least two foaming agents different from each other in the foaming temperature; and a process for producing the thermal transfer image-receiving sheet.

The incorporation of at least two foaming agents different from each other in the foaming temperature in the foaming-agent-containing layer can provide a receiving layer transfer sheet and a thermal transfer image receiving sheet which can form a high-quality and high-density image free from dropout and omission even on a rough paper not having a smooth surface despite a remarkable temperature change during the formation of an image.

A fourth embodiment of the invention provides a receiving layer transfer sheet comprising a substrate sheet and a transferable resin layer provided on one surface of the substrate sheet, wherein said transferable resin layer comprises a dye-receiving layer and a cell-containing layer and said cell-containing layer comprises a cell and/or a foaming agent having an average particle diameter of 20 μm or less; a thermal transfer image-receiving sheet comprising a substrate sheet and a resin layer provided on one surface of the substrate sheet, wherein said resin layer comprises a dye-receiving layer and a cell-containing layer and said cell-containing layer comprises a cell and/or a foaming agent having an average particle diameter of 40 μm or less; and a process for producing a thermal transfer image-receiving sheet, wherein the transferable resin layer of said receiving layer transfer sheet is transferred to a substrate sheet.

The incorporation of a cell and/or a foaming agent having an average particle diameter of 20 μm or less (in the case of a receiving layer transfer sheet) or 40 μm or less (in the case of a thermal transfer image receiving sheet) in the cell-containing layer enables a cell-containing layer, which is homogeneous and dense and has an excellent smoothness, to be formed, which contributes to an improvement in the surface smoothness of the dye-receiving layer formed on the cell-containing layer, so that it becomes possible to provide a receiving layer transfer sheet and a thermal transfer image-receiving sheet which enable a high-quality and high-density image free from dropout and omission of a dot to be formed even on a rough paper or other paper not having a smooth surface. Further, in the case of a thermal transfer image-receiving sheet, when the foaming agent is already in a foamed state, since the energy applied during the transfer of the dye is less liable to be consumed in the foaming, sufficient cushioning can be attained even when the printing energy is low, so that it becomes possible to form an image having a higher quality.

BRIEF DESCRIPTION OF THE INVENTION

DETAILED DESCRIPTION OF THE INVENTION

The present invention will now be described in more detail with reference to the following preferred embodiments of the present invention.

First Embodiment of the Invention

Figure 1:
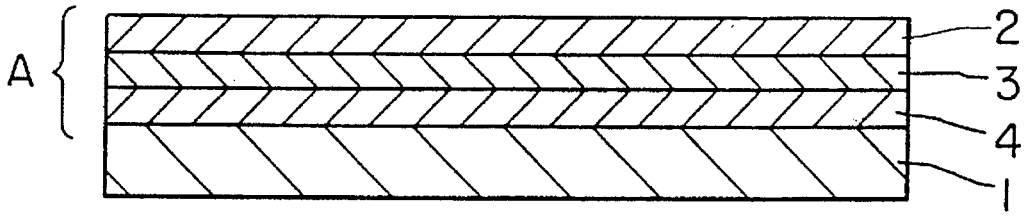
FIG. 1 is a cross-sectional view of the thermal transfer image-receiving sheet according to the present invention.

As schematically shown in FIG. 1, the thermal transfer image-receiving sheet of the first invention is characterized in that a resin layer A comprising at least dye-receiving layer 2 and including a hollow capsule having a volumetric hollowness of 50% or more is provided on a substrate sheet 1.

The substrate sheet 1 used in the present invention is not particularly limited, and examples thereof include plain paper, wood free paper, tracing paper and plastic films. It may be in the from of any of a card, a postcard, a passport, a letter paper, a paper for a report, a notebook and a catalog. In particular, the present invention is applicable also to a plain paper having a rough surface and a rough paper.

The resin layer A formed on the surface of the substrate sheet and comprising at least a dye-receiving layer 2 may consist of the receiving layer alone. Alternatively, as shown in FIG. 1, it may further comprise, besides the receiving layer, an intermediate layer or a barrier layer (hereinafter referred to simply as "intermediate layer 3") and/or an adhesive layer or a pressure sensitive adhesive layer (hereinafter referred to simply as "adhesive layer 4"). At least one of these layers may contain a hollow capsule having a volumetric hollowness of 50% or more.

The above-described dye-receiving layer 2 serves to receive a sublimable dye migrating from the thermal transfer sheet and to maintain the formed image.

Examples of the resin for forming the dye-receiving layer include a polyolefin resin such as polypropylene, a halogenated polymer such as polyvinyl chloride, a vinyl chloride/vinyl acetate copolymer or polyvinylidene chloride, a vinyl polymer such as polyvinyl acetate or polyacrylic ester, a polyester resin such as polyethylene terephthalate or polybutylene terephthalate, a polystyrene resin, a polyamide resin, a resin of a copolymer of an olefin such as ethylene or propylene with other vinyl monomer, an ionomer, a cellulose resin such as cellulose diacetate and a polycarbonate resin. Among them, a vinyl resin and a polyester resin are particularly preferred.

A silicone oil, a phosphoric ester surfactant, a fluorosurfactant, etc. are preferably used as a release agent to be mixed with the above-described resin. Among them, the silicone oil is particularly preferred. Preferred examples of the silicone oil include modified silicone oils such as epoxy-modified, alkyl-modified, amino-modified, carboxyl-modified, alcohol-modified, fluorine-modified, alkylaralkylpolyether-modified, epoxy/polyether-modified and polyether-modified silicone oils.

The release agent may be used alone or in the form of a mixture of two or more of them. The amount of addition of the release agent is preferably 0.5 to 30 parts by weight based on 100 parts by weight of the resin for forming a dye-receiving layer. When the amount is less than the dye-described range, problems such as fusing between the thermal transfer sheet and the dye-receiving layer or a lowering in the printing sensitivity often occur. The addition of the above-described release agent to the dye-receiving layer causes the release agent to bleed out on the surface of the receiving layer after transfer to form a release layer.

The receiving layer 2 can be formed by coating one surface of the substrate sheet with a suitable organic solvent solution or organic solvent or water dispersion of a mixture of the above-described resin with necessary additives such as a release agent, for example, by a gravure printing method, a screen printing method or a reverse roll coating method wherein use is made of a gravure plate, and drying the resultant coating.

In the formation of the dye-receiving layer, it is possible to add fillers such as kaolin clay, calcium carbonate and finely divided silica for the purpose of improving the writing quality and coating strength.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

If necessary, an intermediate layer 3 may be formed between the receiving layer 2 and the substrate sheet. When the above described hollow capsule is included in the adhesive layer 4 which may be formed on the surface of the substrate sheet, the intermediate layer 3 serves to prevent the surface of the receiving layer 2 from becoming uneven and, at the same time, the receiving layer from breaking due to rupture of the hollow capsule. Further, it serves also to prevent the lowering in the adhesive property of the adhesive layer due to migration of the release agent added to the receiving layer into the adhesive layer 4. The intermediate layer preferably comprises a relatively hard resin or elastic resin. Such an intermediate layer may be omitted, and the adhesive layer may be provided on the surface of the substrate sheet without providing the intermediate layer.

The intermediate layer 3 can be formed by coating a solution of a resin having a good film forming property, for example, a polyamide resin, an acrylic resin, a vinyl chloride resin, an ethylene/vinyl chloride copolymer resin, a vinyl chloride/vinyl acetate copolymer resin or a polyester resin and drying the coating to form a layer preferably having a thickness of about 0.1 to 5 μm. The intermediate layer 3 may comprise a resin having an improved strength such as one produced by at least partially crosslinking the above-described resin or curing the above described resin by means of an electron beam or an ultraviolet radiation. It is a matter of course that a hollow capsule can be included in the intermediate layer.

The adhesive layer 4 which may be provided between the intermediate layer 3 and the substrate sheet 1 can be formed, for example, by coating a solution of a resin having a hot adhesive property, for example, a polyamide resin, an epoxy resin, an acrylic resin, a vinyl chloride resin, a vinyl chloride/vinyl acetate copolymer resin or a polyester resin, and drying the resultant coating to form a layer having a thickness of about 0.5 to 10 μm. It is a matter of course that a known pressure sensitive agent may be used instead of the heat sensitive adhesive.

The hollow capsule included in at least one of the dye-receiving layer 2, intermediate layer 3 and adhesive layer 4 is a capsule produced, for example, by foaming a known foaming agent such as a microballoon comprising a low-boiling liquid such as butane or pentane microcapsulated in a resin such as polyvinylidene chloride or polyacrylonitrile. Further, a microballoon coated with a white pigment or the like can be effectively used. Particularly preferred examples of the foaming agent include the above-described microballoon which can be easily subjected to a foaming treatment at a relatively low temperature, a foam produced by foaming the microballoon and a microballoon coated with a white pigment. For example, various grades of foaming agents are available from Matsumoto Yushi Seiyaku Co., Ltd., and all of them are useable in the present invention.

These foaming agents may be added in an unfoamed state, and it is satisfactory that the added forming agents are foamed to form a hollow capsule in a final stage, that is, in the form of a thermal transfer image-receiving sheet. Alternatively, they may be added in a previously foamed state to the above-described resin layer. It is also possible to use a method wherein the foaming agent is incorporated in an unfoamed state in the resin layer and allowed to remain unfoamed state and heat-foamed by heat from a thermal head during the formation of an image.

The volumetric hollowness of the hollow capsule should be 50% or more. When the volumetric hollowness is less than 50%, no satisfactory cushioning and heat insulating properties can be attained. The best results can be attained when the volumetric hollowness is 90% or more, for example, 90 to 99.0%. The particle diameter of these hollow capsules is preferably 0.2 to 40 μm, still preferably 0.2 to 30 μm. When the particle diameter is less than 0.2 μm, the cushioning and insulating properties are unsatisfactory. On the other hand, when the particle diameter exceeds 40 μm, it is difficult to form a smooth coating, which is unfavorable from the viewpoint of formation of an image. The thickness of the partition wall of the hollow capsule is preferably in the range of from 0.05 to 5 μm. When the thickness is excessively small, the capsule is liable to break during the production thereof or the formation of an image. On the other hand, when the thickness is excessively large, the cushioning property becomes poor.

The term "volumetric hollowness" used in the present invention is intended to mean a value determined by a calculation according to the following equation:

$$\text{Volumetric hollowness}=B/(A\times C)$$

wherein A represents the average thickness of the hollow layer (μm);

B represents the weight of the hollow layer ($g/m^2$); and

C represents the specific gravity of the resin constituting the hollow layer ($g/cm^3$).

The term "hollow layer" used herein is intended to mean a resin layer including a hollow capsule.

For the above-described reason, it is preferred that the hollow capsule be included in the adhesive layer. When the hollow capsule is included in the adhesive layer, it is preferred for the adhesive to have a Tg value of 80° C. or below. The use of such an adhesive enables the cushioning property of the hollow capsule to be sufficiently utilized and a good adhesion to the substrate sheet to be exhibited in the step of dry laminating in the production of an image-receiving sheet.

The thickness of the layer including a hollow capsule is preferably 2 to 70 μm, still preferably 2 to 50 μm. When the thickness is excessively small, no sufficient cushioning and insulating properties can be attained. On the other hand, when the thickness is excessively large, the surface of the receiving layer is liable to damage, which is causative of a lowering in the productivity or an unsatisfactory printing.

The hollowness of the layer including a hollow capsule is preferably 10 to 90%. When the hollowness is less than 10%, no sufficient cushioning and insulating properties can be attained. When the hollowness exceeds 90%, the strength of the layer becomes unsatisfactory.

In the present invention, the incorporation of a filler, a white pigment, a fluorescent brightener, etc. in at least one of the above-described layers can provide a receiving layer having an excellent whiteness independently of the ground color of the transfer material.

The above described image-receiving sheet according to the present invention includes an embodiment wherein the layer including the hollow capsule comprises a resin, a hollow capsule and a void. The term "void" used herein is intended to mean a microcell formed by, for example, a decomposable foaming agent, and the coexistence of the hollow capsule and the void enables the cushioning property to be further enhanced. However, when the proportion of the void is excessively large, the coating strength lowers. Therefore, it is preferred to properly regulate the proportion of the hollow capsule to the void.

It is also possible to form the thermal transfer image-receiving sheet according to the present invention by a method which comprises preparing coating solutions for forming the adhesive layer, intermediate layer and receiving layer with the above-described hollow capsule being incorporated in at least one coating solution (preferably a coating solution for forming the adhesive layer) and successively forming on the substrate sheet individual layers on top of another by applying the above-described coating solutions.

Further, the thermal transfer image-receiving sheet according to the present invention can be formed also by a method which comprises forming a transferable resin layer including the above-described receiving layer on a releasable sheet, such as a polyester film, to prepare a transfer sheet and using the transfer sheet to transfer the transferable resin layer including the receiving layer onto the above-described substrate sheet by any heat pressing means capable of heating the sheet to a temperature at which the receiving layer or adhesive layer is activated, such as a hot stamper for a transfer foil, a hot roll or a hot laminator. When the adhesive layer comprises a pressure sensitive agent, heating is not essential during transfer.

Second Embodiment of the Invention

Figure 2:
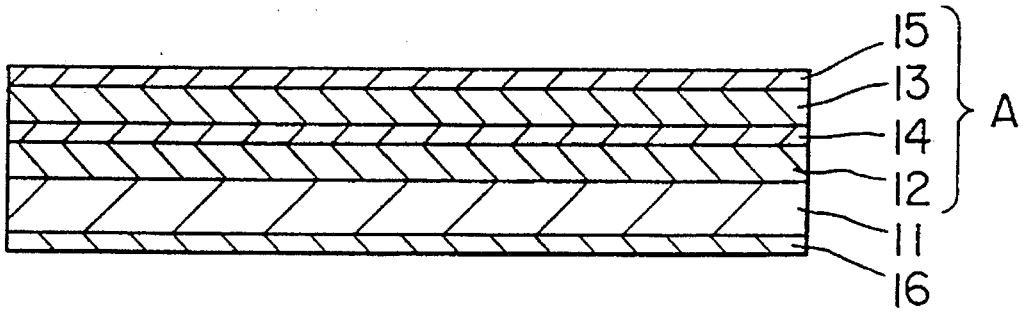
FIG. 2 is a cross-sectional view of the receiving layer transfer sheet according to the present invention.

One embodiment of the receiving layer transfer sheet according to the second invention is schematically shown in FIG. 2. The receiving layer transfer sheet comprises a transferable resin layer A provided on one surface of a substrate sheet 11, and is characterized in that the transferable resin layer A comprises a dye receiving layer 12 and a cell-containing layer 13 and the cell-containing layer 13 contains a cell and/or a foaming agent capable of increasing the thickness of the transferable resin layer 18 by a factor of 1.1 to 4 upon being heated.

If necessary, the resin layer may further comprise an intermediate layer 14 and an adhesive layer 15. Further, the receiving layer transfer sheet may comprise a heat-resistant lubricating layer 16. These intermediate layer or adhesive layer as well can contain a cell and/or a foaming agent.

There is no particular limitation on the substrate sheet used in the receiving layer transfer sheet according to the present invention. Specifically, a substrate sheet used in the conventional thermal transfer sheet, as such, may be used, and use may be made of other substrate sheets.

Specific preferred examples of the substrate sheet include thin paper such as glassine paper, capacitor paper and paraffin paper, plastics such as polyesters, polypropylene, cellophane, polycarbonate, cellulose acetate, polyethylene, polyvinyl chloride, polystyrene, nylon, polyimide, polyvinylidene chloride and ionomers, and substrate sheets produced by compositing these plastics with the above-described paper.

The thickness of the substrate sheet can be properly varied depending upon the material so that suitable strength, heat resistance and other properties can be attained. The thickness is preferably 3 to 100 μm.

It is also preferred to form a peeling layer (not shown) on the surface of the substrate sheet prior to the formation of the receiving layer. The peeling layer is formed by using a release agent such as a water-soluble resin, a hydrophilic resin, a wax, a silicone wax, a silicone resin, a fluororesin and an acrylic resin. It can be formed in the same manner as that used in the formation of the receiving layer which will be described later. A thickness of about 0.1 to 5 μm suffices for the release layer. When a matte receiving layer as transferred is preferred, the surface can be rendered matte by incorporating various particles in the peeling layer or using a substrate sheet wherein the surface on the peeling layer side has been subjected to a matting treatment. It is a matter of course that the formation of the peeling layer is unnecessary when the substrate sheet has a suitable peelability.

The dye-receiving layer formed on the surface of the substrate sheet or peeling layer serves to receive a sublimable dye migrating from the thermal transfer sheet after the transfer of the receiving layer to any transfer material and to maintain the formed image.

Examples of the resin for forming the dye-receiving layer include a polyolefin resin such as polypropylene, a halogenated polymer such as a vinyl chloride/vinyl acetate copolymer, polyvinyl chloride or polyvinylidene chloride, a vinyl polymer such as polyvinyl acetate or polyacrylic ester, a polyester resin such as polyethylene terephthalate or polybutylene terephthalate, a polystyrene resin, a polyamide resin, a resin of a copolymer of an olefin such as ethylene or propylene with other vinyl monomer, an ionomer, a cellulose resin such as cellulose diacetate and a polycarbonate resin. Among them, a vinyl resin and a polyester resin are particularly preferred.

A silicone oil, a phosphoric ester surfactant, a fluorosurfactant, etc. are preferably used as a release agent to be mixed with the abovedescribed resin. Among them, the silicone oil is particularly preferred. Preferred examples of the silicone oil include modified silicone oils such as epoxy-modified, alkyl-modified, amino-modified, carboxyl-modified, alcohol-modified, fluorine-modified, alkylaralkylpolyether-modified, epoxy/polyether-modified and polyether-modified silicone oils.

The release agents may be used alone or in the form of a mixture of two or more of them. The amount of addition of the release agent is preferably 0.5 to 30 parts by weight based on 100 parts by weight of the resin for forming a dye-receiving layer. When the amount is less than the above-described range, problems such as fusing between the thermal transfer sheet and the dye-receiving layer or a lowering in the printing sensitivity often occur. The addition of the above-described release agent to the dye-receiving layer causes the release agent to bleed out on the surface of the receiving layer after transfer to form a release layer.

The receiving layer can be formed by coating one surface of the substrate sheet (or a release layer) with a suitable organic solvent solution or organic solvent or water dispersion of a mixture of the above-described resin with necessary additives such as a release agent, for example, by a gravure printing method, a screen printing method or a reverse roll coating method wherein use is made of a gravure plate, and drying the resultant coating.

In the formation of the dye-receiving layer, it is possible to add fillers such as kaolin clay, calcium carbonate and finely divided silica for the purpose of improving the peelability of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

Further, an intermediate layer 14 may be formed on the surface of the receiving layer. The intermediate layer can be formed by coating a solution of a resin having a good film forming property, for example, a polyamide resin, an acrylic resin, a vinyl chloride resin, an ethylene/vinyl acetate copolymer resin, a vinyl chloride/vinyl acetate copolymer resin or a polyester resin and drying the coating to form a layer preferably having a thickness of about 0.1 to 10 μm. The formation of the intermediate layer contributes to the prevention of occurrence of an uneven portion or a pinhole in the dye-receiving layer due to foaming or expansion of the cell-containing layer and further contributes to an improvement in the strength, adhesion, etc.

The cell-containing layer provided on the intermediate layer or dye-receiving layer can be formed by coating a mixture of a coating solution containing, as a binder, for example, a polyurethane resin, an acrylic resin, a polyethylene resin, a butadiene rubber or an epoxy resin, with a cell and/or a foaming agent, and drying the resultant coating. In the cell-containing layer, the cell or foaming agent may be partially foamed after the formation of the layer. Alternatively, it may not be foamed. The foaming agent may be any known foaming agent, for example, a decomposable foaming agent, which is decomposed upon being heated to evolve a gas such as oxygen, a carbon dioxide gas or nitrogen, such as dinitropentamethylenetetramine, diazoaminobenzene, azobisisobutyronitrile or azodicarbonamide, and a microballoon comprising a low-boiling liquid such as butane or pentane microcapsulated in a resin such as polyvinylidene chloride or polyacrylonitrile. Further, it is also useful to use a foam produced by previously foaming the above-described microballoon or a microballoon coated with a white pigment.

The amount of use of the abovedescribed foaming agent or foam is preferably such that the thickness of the transferable resin layer is increased by 1.1 to 4 times, preferably 2 to 3 times, when the transferable resin layer is heated preferably at 90° to 120° C. for one min. When the foaming ratio (expansion ratio) is less than 1.1 times, it is difficult to attain the object of the present invention. On the other hand, it exceeds 4 times, the adhesion of the transferable resin layer to the transfer material becomes unfavorably poor.

Particularly preferred examples of the foaming agent include the above-described microballoon which can be easily subjected to a foaming treatment at a relatively low temperature, a foam produced by foaming the microballoon and a microballoon coated with a white pigment. For example, various grades of foaming agents are available from Matsumoto Yushi Seiyaku Co., Ltd., and all of them are useable in the present invention. The thickness of the cell-containing layer is preferably about 2 to 10 μm.

In many cases, the foaming or expansion of the cell-containing layer is conducted during the transfer of the transferable resin layer by means of a thermal head. When the transfer is conducted by the thermal head, the transferred layer is crushed due to a pressure applied by the thermal head simultaneously with the foaming, so that there occurs no significant change in the thickness of the transferred resin layer. Therefore, the term "foaming ratio" used herein is intended to mean the foaming ratio in the case of foaming under such a condition that no pressure is applied.

In the present invention, it is preferred to provide an adhesive layer for the purpose of improving the transferability of the transferable resin layer. The adhesive layer is formed, for example, by coating a solution of a resin having a hot adhesive property, for example, a polyamide resin, an acrylic resin, a vinyl chloride resin, a vinyl chloride/vinyl acetate copolymer resin or a polyester resin, and drying the resultant coating to form a layer having a thickness of about 0.5 to 10 μm. A cell and/or a foaming agent may be incorporated in the adhesive layer so that the adhesive layer can serve also as a cell-containing layer.

In the present invention, the incorporation of a filler, a white pigment, a fluorescent brightener, etc. in at least one of the above-described layers can provide a receiving layer having an excellent whiteness independently of the ground color of the transfer material.

Figure 3:
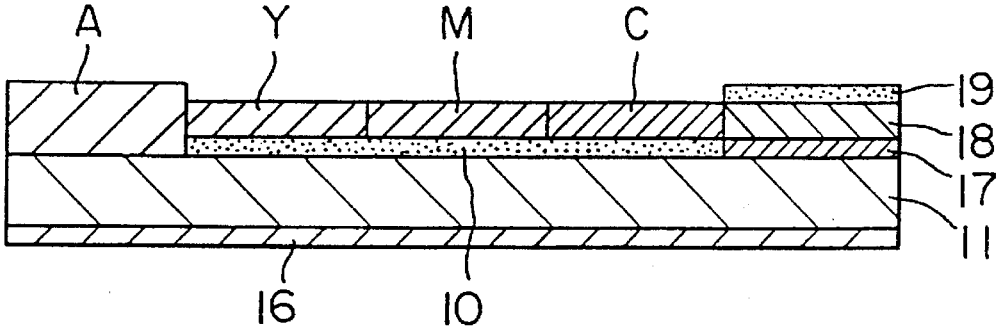
FIG. 3 is a schematic cross-sectional view of another embodiment of the receiving layer transfer sheet according to the present invention.

The above described embodiment is a basic embodiment of the present invention. In the present invention, as shown in FIG. 3, it is also possible to adopt an embodiment wherein the above-described transfer resin layer A is provided on part of a long substrate film 11, dye layers each comprising a sublimable dye, for example, dye layers of yellow Y, magenta M and cyan C and further optionally black Bk (not shown), are successively provided adjacently to the transferable resin layer through an adhesive layer 10, and transferable protective layers (17: release layer, 18: protective layer, and 19: adhesive layer) are provided adjacently to these dye layers for the purpose of protecting the surface of the formed image. In the above described composite thermal transfer sheet, for example, the resin layer A including a dye-receiving layer is first transferred to a necessary region of an image-receiving sheet, such as a postcard, a dye image is formed by the dye layers Y, M, C and Bk on the transferred resin layer including a receiving layer, the protective layers (18, 19) are then transferred onto the surface of the formed image, thereby enabling a desired image to be formed on an arbitrary transfer material by means of a single sheet of a transfer material and one thermal transfer printer.

There is no particular limitation on the transfer material onto which a transfer layer including a receiving layer is transferred by using the above-described receiving layer transfer sheet, and examples thereof include plain paper, wood free paper, tracing paper and plastic films. It may be in the from of any of a card, a postcard, a passport, a letter paper, a paper for a report, a notebook and a catalog. In particular, the present invention is applicable also to a plain paper having a rough surface and a rough paper.

The transfer layer can be transferred by any heat pressing means capable of heating the sheet to a temperature at which the receiving layer or adhesive layer is activated, such as a hot stamper for a transfer foil or a hot roll.

The thermal transfer image-receiving sheet according to the present invention is one produced by the above-described method. Further, a thermal transfer image-receiving sheet having the same function and effect as that described above can be produced by a method which comprises preparing coating solutions for forming an adhesive layer, a cell-containing layer, an intermediate layer and a receiving layer and successively forming, on the transfer material as the substrate sheet, individual layers on top of another by applying the above-described coating solutions.

Although the foaming or expansion of the above-described thermal transfer image-receiving sheet according to the present invention may be conducted during the production of the thermal transfer image receiving sheet, it is preferred to conduct the foaming or expansion by means of heat from the thermal head used in the formation of an image.

Third Embodiment of the Invention

One embodiment of the receiving layer transfer sheet according to the third invention is schematically shown in FIG. 1. The receiving layer transfer sheet comprises a transferable resin layer A provided on one surface of a substrate sheet 1, and is characterized in that the transferable resin layer A comprises a dye-receiving layer 2 and a foaming-agent-containing layer 3 and the foaming-agent-containing layer 3 contains at least two foaming agents different from each other in the foaming temperature. The term "foaming temperature" used in the present invention is intended to mean a temperature at which the foaming agent initiates foaming.

If necessary, the resin layer may further comprise an intermediate layer 4 and an adhesive layer 5. The receiving layer transfer sheet may further comprise a heat-resistant lubricating layer 6. These intermediate layer or adhesive layer as well can contain a cell and/or a foaming agent.

There is no particular limitation on the substrate sheet used in the receiving layer transfer sheet according to the present invention. Specifically, a substrate sheet used in the conventional thermal transfer sheet, as such, may be used, and use may be made of other substrate sheets.

Specific preferred examples of the substrate sheet include thin paper such as glassine paper, capacitor paper and paraffin paper, plastics such as polyesters, polypropylene, cellophane, polycarbonate, cellulose acetate, polyethylene, polyvinyl chloride, polystyrene, nylon, polyimide, polyvinylidene chloride and ionomers, and substrate sheets produced by compositing these plastics with the above-described paper.

The thickness of the substrate sheet can be properly varied depending upon the material so that suitable strength, heat resistance and other properties can be attained. The thickness is preferably 3 to 100 μm.

It is also preferred to form a peeling layer (not shown) on the surface of the substrate sheet prior to the formation of the receiving layer. The peeling layer is formed by using a release agent such as a water-soluble resin, a hydrophilic resin, a wax, a silicone wax, a silicone resin, a fluororesin or an acrylic resin. It can be formed in the same manner as that used in the formation of the receiving layer which will be described later. A thickness of about 0.1 to 5 μm suffices for the peeling layer. When it is preferred for the receiving layer to be in a matte state after transfer, the surface of the receiving layer can be rendered matte by incorporating various particles in the peeling layer or using a substrate sheet wherein the surface on the peeling layer side has been subjected to a matting treatment. It is a matter of course that the formation of the peeling layer is unnecessary when the substrate sheet has a suitable releasability.

The dye-receiving layer formed on the surface of the substrate sheet or peeling layer serves to receive a sublimable dye migrating from the thermal transfer sheet after the transfer of the receiving layer to any transfer material and to maintain the formed image.

Examples of the resin for forming the dye-receiving layer include a polyolefin resin such as polypropylene, a halogenated polymer such as a vinyl chloride/vinyl acetate copolymer, polyvinyl chloride or polyvinylidene chloride, a vinyl polymer such as polyvinyl acetate or polyacrylic ester, a polyester resin such as polyethylene terephthalate or polybutylene terephthalate, a polystyrene resin, a polyamide resin, a resin of a copolymer of an olefin such as ethylene or propylene with other vinyl monomer, an ionomer, a cellulose resin such as cellulose diacetate and a polycarbonate resin. Among them, a vinyl resin and a polyester resin are particularly preferred.

A silicone oil, a phosphoric ester surfactant, a fluorosurfactant, etc. are preferably used as a release agent to be mixed with the above described resin. Among them, the silicone oil is particularly preferred. Preferred examples of the silicone oil include modified silicone oils such as epoxy-modified, alkyl-modified, amino-modified, carboxyl-modified, alcohol-modified, fluorine-modified, alkylaralkylpolyether-modified, epoxy/polyether-modified and polyether-modified silicone oils.

The release agents may be used alone or in the form of a mixture of two or more of them. The amount of addition of the release agent is preferably 0.5 to 30 parts by weight based on 100 parts by weight of the resin for forming a dye-receiving layer. When the amount is less than the above-described range, problems such as fusing between the thermal transfer sheet and the dye-receiving layer or a lowering in the printing sensitivity often occur. The addition of the above-described release agent to the dye-receiving layer causes the release agent to bleed out on the surface of the receiving layer after transfer to form a peeling layer.

The receiving layer can be formed by coating one surface of the substrate sheet (or a peeling layer) with a suitable organic solvent solution or organic solvent or water dispersion of a mixture of the above-described resin with necessary additives such as a release agent, for example, by a gravure printing method, a screen printing method or a reverse roll coating method wherein use is made of a gravure plate, and drying the resultant coating.

In the formation of the dye-receiving layer, it is possible to add fillers such as kaolin clay, calcium carbonate and finely divided silica for the purpose of improving the peelability of the receiving layer.

Although the thickness of the dye-receiving layer formed by the above-described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

Further, an intermediate layer 4 may be formed on the surface of the receiving layer. The intermediate layer can be formed by coating a solution of a resin having a good film forming property, for example, a polyamide resin, an acrylic resin, a vinyl chloride resin, an ethylene/vinyl chloride copolymer resin, a vinyl chloride/vinyl acetate copolymer resin or a polyester resin and drying the coating to form a layer preferably having a thickness of about 0.1 to 10 μm.

The formation of the intermediate layer contributes to the prevention of occurrence of an uneven portion or a pinhole in the dye-receiving layer due to foaming or expansion of the cell-containing layer and further contributes to an improvement in the strength, adhesion, etc.

The foaming-agent-containing layer provided on the intermediate layer or dye-receiving layer can be formed by coating a mixture of a coating solution containing, as a binder, for example, a polyurethane resin, an acrylic resin, a polyethylene resin, a butadiene rubber or an epoxy resin, with a foaming agent, and drying the resultant coating. In the foaming-agent-containing layer, the cell or foaming agent may be partially foamed after the formation of the layer. Alternatively, it may not be foamed. The foaming agent may be any known foaming agent, for example, a decomposable foaming agent, which decomposes at a relatively high temperature (for example, 100° to 250° C.) to evolve a gas such as oxygen, a carbon dioxide gas or nitrogen, such as dinitropentamethylenetetramine, diazoaminobenzene, azobisisobutyronitrile or azodicarbonamide, and a foaming agent, which expands at a relatively low temperature (for example, 40° to 150° C.), such as a microballoon comprising a low-boiling liquid such as butane or pentane microcapsulated in a resin such as polyvinylidene chloride or polyacrylonitrile. Further, it is also useful to use a foam produced by previously foaming the above-described microballoon or a microballoon coated with a white pigment.

In these microballoons as well, the expanding temperature can be arbitrarily varied depending upon the kind of the capsulated volatile liquid. For example, low-temperature type microballoon which expand at a temperature in the range of from 40° to 150° C. and high-temperature type microballoons which expand at a temperature in the range of from 100° to 250° C. are commercially available. All of them can be used in the present invention.

The proportion of use of the low-temperature type foaming agent to the high-temperature type foaming agent may be in the range of from 5:95 to 95:5 in terms of the weight ratio, and is preferably varied according to an atmosphere in which the thermal transfer image receiving sheet is used. For example, when the thermal transfer image-receiving sheet is used in a cold season or a cold district, it is preferred for the proportion of the low-temperature type foaming agent to be high, while when the thermal transfer image receiving sheet is used in a hot season or a hot district or continuously for a long period of time, it is preferred for the proportion of the high-temperature type foaming agent to be high. When the proportion of the low-temperature type foaming agent is excessively low, if the thermal transfer image-receiving sheet is used in a hot season or a hot district or continuously for a long period of time, excessive foaming occurs, which lowers the strength of the receiving layer. On the other hand, when the proportion of the high-temperature type foaming agent is excessively high, no good cushioning property can be attained in a low-temperature region or season.

The total amount of use of the above described foaming agents is preferably such that the thickness of the transferable resin layer is increased by 1.1 to 4 times when the transferable resin layer is heated preferably to 90° to 120° C. When the foaming ratio (expansion ratio) is less than 1.1 times, the cushioning property is unsatisfactory. On the other hand, when the foaming ratio (expansion ratio) exceeds 4 times, the adhesion of the image-receiving layer to the substrate becomes unfavorably poor.

Particularly preferred examples of the foaming agent include the above-described microballoon which can be easily foamed or expanded at a relatively low temperature, a foam produced by foaming the microballoon and a microballoon coated with a white pigment. For example, various grades of foaming agents are available from Matsumoto Yushi Seiyaku Co., Ltd., and all of them are useable in the present invention. The thickness of the foaming-agent-containing layer is preferably about 2 to 10 μm.

Further, it is possible to produce a transfer sheet and an image-receiving sheet by a method wherein use is made of a low-temperature type foaming agent and a high-temperature type foaming agent and foaming is conducted under such a condition that the low-temperature type foaming agent is foamed with the high-temperature type foaming agent remaining unfoamed. In this case, the effect of the low-temperature type foaming agent in a foamed state is attained in a low energy region, and the effect of the high-temperature type foaming agent in an unfoamed state is attained in a high energy region, so that an image having a high quality and a high sensitivity can be expected over the whole energy region.

Further, in the present invention, it is preferred to provide an adhesive layer for the purpose of improving the transferability of the transferable resin layer. The adhesive layer is formed, for example, by coating a solution of a resin having a hot adhesive property, for example, a polyamide resin, an acrylic resin, a vinyl chloride resin, a vinyl chloride/vinyl acetate copolymer resin or a polyester resin, and drying the resultant coating to form a layer preferably having a thickness of about 0.5 to 10 μm. A foaming agent may be incorporated in the adhesive layer so that the adhesive layer can serve also as a foaming-agent-containing layer.

In the present invention, the incorporation of a filler, a white pigment, a fluorescent brightener, etc. in at least one of the above-described layers can provide a receiving layer having an excellent whiteness independently of the ground color of the transfer material.

The above described embodiment is a basic embodiment of the present invention. In the present invention, as shown in FIG. 3, it is also possible to adopt an embodiment wherein the above described transfer resin layer A is provided on part of a long substrate film 11, dye layers each comprising a sublimable dye, for example, dye layers of yellow Y, magenta M and cyan C and further optionally black Bk, are successively provided adjacently to the transferable resin layer, and transferable protective layers (17: peeling layer, 18: protective layer, and 19: adhesive layer) are provided adjacently to these dye layers for the purpose of protecting the surface of the formed image. In the above-described composite thermal transfer sheet, for example, the resin layer A including a dye-receiving layer is first transferred to a necessary region of an image-receiving sheet, such as a postcard. A dye image is formed by the dye layers Y, M and C on the transferred resin layer including a receiving layer. The protective layers (18, 19) are then transferred onto the surface of the formed image, thereby enabling a desired image to be formed on an arbitrary transfer material by means of a single sheet of a transfer material and one thermal transfer printer.

There is no particular limitation on the transfer material onto which a transfer layer including a receiving layer is transferred by using the above described receiving layer transfer sheet, and examples thereof include plain paper, wood free paper, tracing paper and plastic films. It may be in the from of any of a card, a postcard, a passport, a letter paper, a paper for a report, a notebook and a catalog. In particular, the present invention is applicable also to a plain paper having a rough surface and a rough paper.

The transfer layer can be transferred by any heat pressing means capable of heating the sheet to a temperature at which the receiving layer or adhesive layer is activated, such as a hot stamper for a transfer foil or a hot roll.

The thermal transfer image-receiving sheet according to the present invention is one produced by the above-described method. Further, a thermal transfer image-receiving sheet having the same function and effect as that described above can be produced by a method which comprises preparing coating solutions for forming an adhesive layer, a cell-containing layer, an intermediate layer and a receiving layer and successively forming, on the transfer material as the substrate sheet, individual layers on top of another by applying the above-described coating solutions.

Although the foaming or expansion of the above-described thermal transfer image-receiving sheet according to the present invention may be conducted during the production of the thermal transfer image-receiving sheet, it is preferred to conduct the foaming or expansion by means of heat from the thermal head used in the formation of an image.

Fourth Embodiment of the Invention

One embodiment of the receiving layer transfer sheet according to the third invention is schematically shown in FIG. 2. The receiving layer transfer sheet comprises a transferable resin layer A provided on one surface of a substrate sheet 11, and is characterized in that the transferable resin layer A comprises a dye-receiving layer 12 and a cell-containing layer 13 and the cell-containing layer 13 comprises a cell and/or a foaming agent having an average particle diameter of 20 μm or less.

If necessary, the resin layer may further comprises an intermediate layer 14 and an adhesive layer 15. The receiving layer transfer sheet may further comprise a heat-resistant lubricating layer 16. These intermediate layer or adhesive layer as well can contain a cell and/or a foaming agent.

There is no particular limitation on the substrate sheet used in the receiving layer transfer sheet according to the present invention. Specifically, a substrate sheet used in the conventional thermal transfer sheet, as such, may be used. Further, use may be made of other substrate sheets.

Specific preferred examples of the substrate sheet include thin paper such as glassine paper, capacitor paper and paraffin paper, plastics such as polyesters, polypropylene, cellophane, polycarbonate, cellulose acetate, polyethylene, polyvinyl chloride, polystyrene, nylon, polyimide, polyvinylidene chloride and ionomers, and substrate sheets produced by compositing these plastics with the above-described paper.

The thickness of the substrate sheet can be properly varied depending upon the material so that suitable strength, heat resistance and other properties can be attained. The thickness is preferably 3 to 100 μm.

It is also preferred to form a peeling layer (not shown) on the surface of the substrate sheet prior to the formation of the receiving layer. The peeling layer is formed by using a release agent such as a water-soluble resin, a hydrophilic resin, a wax, a silicone wax, a silicone resin, a fluororesin and an acrylic resin. It can be formed in the same manner as that used in the formation of the receiving layer which will be described later. A thickness of about 0.1 to 5 μm suffices for the peeling layer. When a matte receiving layer as transferred is preferred, the surface can be rendered matte by incorporating various particles in the peeling layer or using a substrate sheet wherein the surface on the peeling layer side has been subjected to a matting treatment. It is a matter of course that the formation of the peeling layer is unnecessary when the substrate sheet has a suitable releasability.

The dye-receiving layer formed on the surface of the substrate sheet or peeling layer serves to receive a sublimable dye migrating from the thermal transfer sheet after the transfer of the receiving layer to any transfer material and to maintain the formed image.

Examples of the resin for forming the dye-receiving layer include a polyolefin resin such as polypropylene, a halogenated polymer such as a vinyl chloride/vinyl acetate copolymer, polyvinyl chloride or polyvinylidene chloride, a vinyl polymer such as polyvinyl acetate or polyacrylic ester, a polyester resin such as polyethylene terephthalate or polybutylene terephthalate, a polystyrene resin, a polyamide resin, a resin of a copolymer of an olefin such as ethylene or propylene with other vinyl monomer, an ionomer, a cellulose resin such as cellulose diacetate and a polycarbonate resin. Among them, a vinyl resin and a polyester resin are particularly preferred.

A silicone oil, a phosphoric ester surfactant, a fluorosurfactant, etc. are preferably used as a release agent to be mixed with the above-described resin. Among them, the silicone oil is particularly preferred. Preferred examples of the silicone oil include modified silicone oils such as epoxy-modified, alkyl-modified, amino-modified, carboxyl-modified, alcohol-modified, fluorine-modified, alkylaralkylpolyether-modified, epoxy/polyether-modified and polyether-modified silicone oils.

The release agents may be used alone or in the form of a mixture of two or more of them. The amount of addition of the release agent is preferably 0.5 to 30 parts by weight based on 100 parts by weight of the resin for forming a dye-receiving layer. When the amount is less than the abovedescribed range, problems such as fusing between the thermal transfer sheet and the dye-receiving layer or a lowering in the printing sensitivity often occur. The addition of the above described release agent to the dye-receiving layer causes the release agent to bleed out on the surface of the receiving layer after transfer to form a release layer.

The receiving layer can be formed by coating one surface of the substrate sheet (or a peeling layer) with a suitable organic solvent solution or organic solvent or water dispersion of a mixture of the above-described resin with necessary additives such as a release agent, for example, by a gravure printing method, a screen printing method or a reverse roll coating method wherein use is made of a gravure plate, and drying the resultant coating.

In the formation of the dye-receiving layer, it is possible to add fillers such as kaolin clay, calcium carbonate and finely divided silica for the purpose of improving the peelability of the receiving layer.

Although the thickness of the dye-receiving layer formed by the above described method may be arbitrary, it is generally in the range of from 1 to 50 μm. It is preferred for the dye-receiving layer to comprise a continuous coating. However, the dye-receiving layer may be formed as a discontinuous coating through the use of a resin emulsion or a resin dispersion.

Further, an intermediate layer 14 may be formed on the surface of the receiving layer. The intermediate layer can be formed by coating a solution of a resin having a good forming property, for example, a polyamide resin, an acrylic resin, a vinyl chloride resin, an ethylene/vinyl acetate copolymer resin, a vinyl chloride/vinyl acetate copolymer resin or a polyester resin, and drying the coating to form a layer preferably having a thickness of 0.1 to 10 μm. The formation of such an intermediate layer can prevent the occurrence of an uneven portion or a pinhole in the dye-receiving layer due to foaming or expansion of the cell-containing layer and, at the same time, can improve the strength and adhesion of the receiving layer.

The cell-containing layer formed on the dye-receiving layer can be foamed by coating a coating solution containing as a binder, for example, a thermoplastic resin such as a polyurethane resin, an acrylic resin, a polyethylene resin, a butadiene rubber or an epoxy resin and, incorporated therein, a cell and/or a foaming agent having an average particle diameter of 20 μm or less, preferably 1 to 20 μm, and drying the coating. When the average particle diameter exceeds 20 μm, there occur the above-described various problems. On the other hand, it is difficult to obtain a cell or foaming agent having an average particle diameter of 1 μm or less. However, the following solid, heat-decomposable foaming agent may be used after pulverization to an average particle diameter of about 0.1 μm.

In the cell-containing layer, the cell or foaming agent may be partially foamed after the formation of the layer. Alternatively, it may not be foamed. When the foaming is conducted, it is preferred to use such a foaming agent that the particle diameter of the foamed cell becomes 40 μm or less. The foaming agent may be any known foaming agent, for example, a decomposable foaming agent, which is decomposed upon being heated to evolve a gas such as oxygen, a carbon dioxide gas or nitrogen, such as dinitropentamethylenetetramine, diazoaminobenzene, azobisisobutyronitrile or azodicarbonamide, and a microballoon comprising a low-boiling liquid such as butane or pentane microcapsulated in a resin such as polyvinylidene chloride or polyacrylonitrile. Further, it is also useful to use a foam produced by previously foaming the above-described microballoon or a microballoon coated with a white pigment.

The amount of use of the above-described foaming agent or foam is preferably such that the thickness of the transferable resin layer is increased by 1.1 to 4 times when the transferable resin layer is heated preferably to 90° to 120° C. for one min. When the foaming ratio (expansion ratio) is less than 1.1 times, it is difficult to attain the object of the present invention. On the other hand, it exceeds 4 times, the adhesion of the transferable resin layer to the transfer material becomes unfavorably poor.

Particularly preferred examples of the foaming agent include the above-described microballoon which can be easily foamed at a relatively low temperature, a foam produced by foaming the microballoon and a microballoon coated with a white pigment. For example, various grades of foaming agents are available from Matsumoto Yushi Seiyaku Co., Ltd., and all of them are useable in the present invention. The thickness of the cell-containing layer is preferably about 2 to 20 μm.

In the present invention, it is preferred to provide an adhesive layer for the purpose of improving the transferability of the transferable resin layer. The adhesive layer is formed, for example, by coating a solution of a resin having a hot adhesive property, for example, a polyamide resin, an acrylic resin, a vinyl chloride resin, a vinyl chloride/vinyl acetate copolymer resin or a polyester resin, and drying the resultant coating to form a layer having a thickness of about 0.5 to 10 μm. A cell and/or a foaming agent may be incorporated in the adhesive layer so that the adhesive layer can serve also as a cell-containing layer.

In the present invention, the incorporation of a filler, a white pigment, a fluorescent brightener, etc. in at least one of the above-described layers can provide a receiving layer having an excellent whiteness independently of the ground color of the transfer material.

The above-described embodiment is a basic embodiment of the present invention. In the present invention, as shown in FIG. 3, it is also possible to adopt an embodiment wherein the above-described transfer resin layer A is provided on part of a long substrate film 11, dye layers each comprising a sublimable dye, for example, dye layers of yellow Y, magenta M and cyan C and further optionally black Bk, are successively provided adjacently to the transferable resin layer, and transferable protective layers (17: release layer, 18: protective layer, and 19: adhesive layer) are provided adjacently to these dye layers for the purpose of protecting the surface of the formed image. In the above-described composite thermal transfer sheet, for example, the resin layer A including a dye-receiving layer is first transferred to a necessary region of an image-receiving sheet, such as a postcard, a dye image is formed by the dye layers Y, M and C on the transferred resin layer including a receiving layer. The protective layers (18, 19) are then transferred onto the surface of the formed image, thereby enabling a desired image to be formed on an arbitrary transfer material by means of a single sheet of a transfer material and one thermal transfer printer.

There is no particular limitation on the transfer material onto which a transfer layer including a receiving layer is transferred by using the above described receiving layer transfer sheet, and examples thereof include plain paper, wood free paper, tracing paper and plastic films. It may be in the from of any of a card, a postcard, a passport, a letter paper, a paper for a report, a notebook and a catalog. In particular, the present invention is applicable also to a plain paper having a rough surface and a rough paper.

The transfer layer can be transferred by any heat pressing means capable of heating the sheet to a temperature at which the receiving layer or adhesive layer is activated, such as a hot stamper for a transfer foil or a hot roll.

The thermal transfer image-receiving sheet according to the present invention is one produced by the above-described method. Further, a thermal transfer image-receiving sheet having the same function and effect as that described above can be produced by a method which comprises preparing coating solutions for forming an adhesive layer, a cell-containing layer, an intermediate layer and a receiving layer and successively forming, on the transfer material as the substrate sheet, individual layers on top of another by applying the above-described coating solutions.

When the cell or foaming agent is foamed, it is preferred to use a foaming agent having such a particle diameter that the particle diameter of the foamed cell is 40 μm or less.

Although the foaming or expansion of the above-described thermal transfer image-receiving sheet according to the present invention is preferably conducted during or after the production of the thermal transfer image-receiving sheet, it may be conducted by means of heat from the thermal head used in the formation of an image.

The present invention will now be described in more detail with reference to the following Examples and Comparative Examples. In the Examples and Comparative Examples, "parts" or "%" is by weight unless otherwise specified.

EXAMPLE A1

A coating solution having the following composition for a receiving layer was coated on the surface of a 25 μm-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer. Further, a coating solution for an intermediate layer was coated at a coverage on a dry basis of 3 g/m$^2$ on the receiving layer and dried in the same manner as that described above to form an intermediate layer, and a coating solution for an adhesive layer was coated at a coverage on a dry basis of 2 g/m$^2$ on the intermediate layer and dried in the same manner as that described above to form an adhesive layer. Further, the assembly was laminated on a copying paper, and the polyester film was peeled off to provide the thermal transfer image-receiving sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 1 part |
| Amino-modified silicone (KS-343 manufactured by The Shin-Etsu Chemical Co., Ltd.) | 1 part |
| Methyl ethyl ketone/toluene (weight ratio = 1:1) | 500 parts |
| **Composition of Coating Solution for Intermediate Layer** | |
| Polymethyl methacrylate resin (BR-106 manufactured by Mitsubishi Rayon Co., Ltd.; Tg = 50° C.) | 100 parts |
| Methyl ethyl ketone/toluene (weight ratio = 1:1) | 500 parts |
| **Composition of Coating Solution for Adhesive Layer** | |
| Polymethyl methacrylate resin (BR-106 manufactured by Mitsubishi Rayon Co., Ltd.; Tg = 50° C.) | 100 parts |
| Hollow capsule (SX863 (A) manufactured by Japan Synthetic Rubber Co., Ltd.; hollowness = 70%, particle diameter 0.4 μm, partition wall thickness = 0.13 μm) | 30 parts |
| Titanium oxide (TCA-888 manufactured by Tohchem Products Corporation) | 100 parts |
| Methyl ethyl ketone/toluene (weight ratio = 1:1) (Hollowness of adhesive layer = 21%) | 500 parts |

EXAMPLE A2

A copying paper was directly coated with the same coating solutions as those used in Example A1, except that 15 Parts of a microcapsule (F-30D manufactured by Matsumoto Yushi Seiyaku Co., Ltd.) was used instead of the hollow capsule. Then, foaming was conducted at 120° C. for 2 min to provide the thermal transfer image-receiving sheet according to the present invention. When the section of the foamed coating was observed, it was found that a void was formed due to the generation of a gas during foaming.

Comparative Example A1

A comparative receiving layer transfer sheet was formed in the same manner as that of Example A1, except that no foaming agent was used.

Separately, an ink composition for forming a dye-supporting layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried. Further, several drops of a silicone oil (X-41.4003A manufactured by Sin-Etsu Silicone Co., Ltd.) was dropped on the reverse face by means of a spuit and spread over the whole surface thereof to conduct coating for a reverse face treatment, thereby forming a thermal transfer sheet.

| Composition of Ink for Dye Layer | |
|---|---|
| Disperse dye (Kayaset Yellow 714 manufactured by Nippon Kayaku Co., Ltd.) | 4.0 parts |
| Ethylhydroxy cellulose (manufactured by Hercules) | 5.0 parts |
| Methyl ethyl ketone/toluene (weight ratio = 1:1) | 80.0 parts |
| Dioxane | 10.0 parts |

The receiving layer transfer sheets prepared in the above-described Examples and Comparative Examples were put on a plain paper, and the receiving layer was transferred onto the plain paper by means of a hot roll. Then, the above-described thermal transfer sheet was put on the surface of the receiving layer, and printing was conducted by means of a thermal head under conditions of an output of 1 W/dot, a pulse width of 0.3 to 0.45 msec and a dot density of 3 dots/mm to form a cyan image. The quality of the resultant color image is given in Table 1.

TABLE 1

| | Sharpness of image | Dropout of image |
|---|---|---|
| Ex. A1 | Receiving layer was white, and image was sharp. | Neither dropout nor omission of image occurred. |
| Ex. A2 | Receiving layer was white, and image was sharp. | Neither dropout nor omission of image occurred. |
| Comp. Ex. A1 | Receiving layer was white, and image was sharp. | Dropout and omission of image occurred. |

As described above, the present invention can provide a thermal transfer image-receiving sheet which enables a high-quality and high-density image to be formed with a good thermal energy efficiency even on a rough paper or other paper not having a smooth paper.

EXAMPLE B1

A coating solution having the following composition for a receiving layer was coated on the surface of a 25 m-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer. Further, a coating solution for serving both as a cell-containing layer and an adhesive layer was similarly coated at a coverage on a dry basis of 5 g/m$^2$ and dried to form a layer for serving both as a cell-containing layer and an adhesive layer, thereby providing the receiving layer transfer sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 8 parts |
| Amino-modified silicone (KS-343 manufactured by The Shin-Etsu chemical Co., Ltd.) | 8 parts |
| Isopropyl alcohol/toluene (weight ratio = 1:1) | 400 parts |
| **Composition of Coating Solution for Adhesive Layer** | |
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 15 parts |
| Titanium oxide (TCA-888 manufactured by Tohchem Products corporation) | 100 parts |
| Methyl ethyl ketone/toluene (weight ratio = 1:1) | 300 parts |

EXAMPLE B2

The receiving layer transfer sheet according to the present invention was formed in the same manner as that of Example B1, except that a coating solution having the following composition was used instead of the coating solution for an adhesive.

| Composition of Coating Solution for Adhesive Layer | |
|---|---|
| Polymethyl methacrylate resin (BR-106 manufactured by Mitsubishi Rayon Co., Ltd.) | 100 parts |
| Foaming agent (F-50 manufactured by Matsumoto Yushi Seiyaku Co., Ltd.) | 15 parts |
| Isopropyl alcohol/toluene (weight ratio = 1:1) | 400 parts |

EXAMPLE B3

The receiving transfer layer sheet according to the present invention was formed in the same manner as that of Example B1, except that a coating solution having the following composition was used instead of the coating solution for an adhesive.

| Composition of Coating Solution for Adhesive Layer | |
|---|---|
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 30 parts |
| Isopropyl alcohol/toluene (weight ratio = 1:1) | 400 parts |

EXAMPLE B4

A coating solution having the following composition for a receiving layer was coated on the surface of a 25 m-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer. Further, a coating solution for an intermediate layer was similarly coated on the dye-receiving layer at a coverage on a dry basis of 3 g/m$^2$ and dried to form an intermediate layer, and a coating solution for serving both as a cell-containing layer and an adhesive layer was similarly coated at a coverage on a dry basis of 2 g/m$^2$ and dried to form a layer for serving both as a cell-containing layer and an adhesive layer, thereby providing the receiving layer transfer sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 1 part |
| Amino-modified silicone (KS-343 manufactured by The Shin-Etsu Chemical Co., Ltd.) | 1 part |
| Methyl ethyl ketone/toluene (weight ratio = 1:1) | 500 parts |
| **Composition of Coating Solution for Intermediate Layer** | |
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 5 parts |
| Methyl ethyl ketone/toluene (weight ratio = 1:1) | 500 parts |
| **Composition of Coating Solution for Adhesive Layer** | |
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 10 parts |
| Titanium oxide (TCA-888 manufactured by Tohchem Products Corporation) | 100 parts |
| Methyl ethyl ketone/toluene (weight ratio = 1:1) | 500 parts |

EXAMPLE B5

The receiving layer transfer sheet according to the present invention was formed in the same manner as that of Example B1, except that 15 parts of a microcapsule provided with a titanium coating (F-30D/$TiO_2$ manufactured by Matsumoto Yushi Seiyaku Co., Ltd.) was incorporated instead of the foaming agent used in Example B1.

EXAMPLE B6

The receiving layer transfer sheet according to the present invention was formed in the same manner as that of Example B1, except that 40 parts of a microcapsule (F-50 manufactured by Matsumoto Yushi Seiyaku Co., Ltd.) was used instead of the foaming agent.

Comparative Example B1

A comparative receiving layer transfer sheet was formed in the same manner as that of Example B1, except that use was made of no foaming agent.

Comparative Example B2

The receiving layer transfer sheet according to the present invention was formed in the same manner as that of Example B1, except that 100 parts of a microcapsule (F-30 manufactured by Matsumoto Yushi Seiyaku Co., Ltd.) was used instead of the foaming agent.

Comparative Example B3

The receiving layer transfer sheet according to the present invention was formed in the same manner as that of Example B1, except that 60 parts of a microcapsule (F-30 manufactured by Matsumoto Yushi Seiyaku Co., Ltd.) was used instead of the foaming agent.

An ink for a dye layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried. Further, several drops of a silicone oil (X-41.4003A manufactured by Sin-Etsu Silicone Co., Ltd.) was dropped on the reverse face by means of a spuit and spread over the whole surface thereof to conduct coating for a reverse face treatment, thereby forming a thermal transfer sheet.

| Composition of Ink for Dye Layer | |
|---|---|
| Disperse dye (Kayaset Blue 714 manufactured by Nippon Kayaku Co., Ltd.) | 4.0 parts |
| Ethylhydroxy cellulose (manufactured by Hercules) | 5.0 parts |
| Methyl ethyl ketone/toluene (weight ratio = 1:1) | 80.0 parts |
| Dioxane | 10.0 parts |

The above described receiving layer transfer sheets were put on a plain paper, and the receiving layer was transferred onto the plain paper by means of a hot roll. Then, the above-described thermal transfer sheet was put on the surface of the receiving layer, and printing was conducted by means of a thermal head under conditions of an output of 1 W/dot, a pulse width of 0.3 to 0.45 msec and a dot density of 3 dots/mm to form a cyan image. The quality of the resultant color image is given in Table 2. A change in the thickness of the resin layer which is outside the scope of the present invention when it is heated at 120° C. for one min is also given in Table 2.

As described above, the present invention can provide a receiving layer transfer sheet and a thermal transfer image-receiving sheet which enable a high-quality and high-density image free from dropout and omission of a dot to be formed even on a rough paper or other paper not having a smooth paper by incorporating in a cell-containing layer a cell and/or a foaming agent capable of increasing the thickness of the transfer resin layer by 1.1 to 4 times when the layer was heated.

EXAMPLE C1

A coating solution having the following composition for a receiving layer was coated on the surface of a 25 μm-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer. Further, a coating solution for serving both as a cell-containing layer and an adhesive layer was similarly coated at a coverage on a dry basis of 5 g/m$^2$ and dried to form a layer for serving both as a cell-containing layer and an adhesive layer, thereby providing the receiving layer transfer sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 8 parts |
| Amino-modified silicone (KS-343 manufactured by The Shin-Etsu Chemical Co., Ltd.) | 8 parts |
| Methyl ethyl ketone/toluene (weight ratio = 1:1) | 400 parts |
| **Composition of Coating Solution for Adhesive Layer** | |
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 15 parts |
| Foaming agent (F-80 manufactured by | 15 parts |

TABLE 2

| | Heating temp. (for one min) | Dropout and omission of dot | Homogeneity of density of high-light portion | Adhesion of receiving layer |
|---|---|---|---|---|
| Ex. B1 | 90° C. | Neither dropout nor omission occurred. | Good | Good |
| Ex. B2 | 120° C. | Neither dropout nor omission occurred. | Excellent | Good |
| Ex. B3 | 120° C. | Neither dropout nor omission occurred. | Excellent | Good |
| Ex. B4 | 110° C. | Neither dropout nor omission occurred. | Excellent | Excellent |
| Ex. B5 | 100° C. | Neither dropout nor omission occurred. | Good | Good |
| Ex. B5 | 100° C. | Neither dropout nor omission occurred. | Good | Good |
| Ex. B6 | 110° C. | Neither dropout nor omission occurred. | Good | Good |
| Comp. Ex. B1 | 120° C. | Droupout and omission of dot occured. | Poor | Good*1 |
| Comp. Ex. B2 | 100° C. | Dropout and omission of dot occured. | Excellent | Poor*2 |
| Comp. Ex. B3 | 110° C. | Dropout and omission of dot occurred. | Poor | Good*3 |

Note)
*1foaming ratio = 1 (no foaming)
*2foaming ratio = 6.0
*3foaming ratio = 5.0
(Foaming was conducted under atmospheric pressure.)

-continued

| | |
|---|---|
| Matsumoto Yushi Seiyaku Co., Ltd.) | |
| Titanium oxide (TCA-888 manufactured by Tohchem Products Corporation) | 100 parts |
| Methyl ethyl ketone/toluene (weight ratio = 1:1) | 300 parts |

EXAMPLE C2

The receiving layer transfer sheet according to the present invention was formed in the same manner as that of Example C1, except that a coating solution having the following composition was used instead of the coating solution for an adhesive.

| Composition of Coating Solution for Adhesive Layer | |
|---|---|
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 5 parts |
| Foaming agent (F-50 manufactured by Matsumoto Yushi Seiyaku Co., Ltd.) | 10 parts |
| Methyl ethyl ketone/toluene (weight ratio = 1:1) | 300 parts |

EXAMPLE C3

The receiving transfer layer sheet according to the present invention was formed in the same manner as that of Example C1, except that a coating solution having the following composition was used instead of the coating solution for an adhesive.

| Composition of Coating Solution for Adhesive Layer | |
|---|---|
| Polymethyl methacrylate resin (BR-106 manufactured by Mitsubishi Rayon Co., Ltd.) | 100 parts |
| Foaming agent (F-50 manufactured by Matsumoto Yushi Seiyaku Co., Ltd.) | 15 parts |
| Foaming agent (F-80 manufactured by Matsumoto Yushi Seiyaku Co., Ltd.) | 15 parts |
| Methyl ethyl ketone/toluene (weight ratio = 1:1) | 300 parts |

EXAMPLE C4

A coating solution having the following composition for a receiving layer was coated on the surface of a 25 m-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer. Further, a coating solution for an intermediate layer was similarly coated on the dye-receiving layer at a coverage on a dry basis of 3 g/m$^2$ and dried to form an intermediate layer, and a coating solution for serving both as a cell-containing layer and an adhesive layer was similarly coated at a coverage on a dry basis of 2 g/m$^2$ and dried to form a layer for serving both as a cell-containing layer and an adhesive layer, thereby providing the receiving layer transfer sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 1 part |
| Amino-modified silicone (KS-343 manufactured by The Shin-Etsu Chemical Co., Ltd.) | 1 part |
| Methyl ethyl ketone/toluene (weight ratio = 1:1) | 500 parts |
| Composition of Coating Solution for Intermediate Layer | |
| Polymethyl methacrylate resin (BR-106 manufactured by Mitsubishi Rayon Co., Ltd.) | 100 parts |
| Foaming agent (F-30 manufactured by Matsumoto Yushi Seiyaku Co., Ltd.) | 5 parts |
| Methyl ethyl ketone/toluene (weight ratio = 1:1) | 500 parts |
| Composition of Coating Solution for Adhesive Layer | |
| Polymethyl methacryalte resin (BR-106 manufactured by Mitsubishi Rayon Co., Ltd.) | 100 parts |
| Foaming agent (F-30 manufactured by Matsumoto Yushi Seiyaku Co., Ltd.) | 7 parts |
| Foaming agent (F-80 manufactured by Matsumoto Yushi Seiyaku Co., Ltd.) | 3 parts |
| Titanium oxide (TCA-888 manufactured by Tohchem Products Corporation) | 100 parts |
| Methyl ethyl ketone/toluene (weight ratio = 1:1) | 500 parts |

EXAMPLE C5

The receiving layer transfer sheet according to the present invention was formed in the same manner as that of Example C1, except that 10 parts of a microcapsule provided with a titanium coating (F-30D/$TiO_2$ manufactured by Matsumoto Yushi Seiyaku Co., Ltd.) and 10 parts of an azodicarbonamide foaming agent (Vyniball AK#2 manufactured by Eiwa Chemical Industrial Co., Ltd.) were incorporated instead of the foaming agent used in Example C1.

Comparative Example C1

A comparative receiving layer transfer sheet was formed in the same manner as that of Example C1, except that 10 parts of a microcapsule (F-30 manufactured by Matsumoto Yushi Seiyaku Co., Ltd.) was used alone as the foaming agent.

Comparative Example C2

A comparative receiving layer transfer sheet was formed in the same manner as that of Example C1, except that 10 parts of an azodicarbonamide foaming agent (Vinyfor AK-2 manufactured by Eiwa Chemical Industrial Co., Ltd.) was used alone as the foaming agent.

An ink for a dye layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried. Further, several drops of a silicone oil (X-41.4003A manufactured by Sin-Etsu Silicone Co., Ltd.) was dropped on the reverse face by means of a spuit and spread over the whole surface thereof to conduct coating for a reverse face treatment, thereby forming a thermal transfer sheet.

| Composition of Ink for Dye Layer | |
|---|---|
| Disperse dye (Kayaset Blue 714 manufactured by Nippon Kayaku Co., Ltd.) | 4.0 parts |
| Ethylhydroxy cellulose (manufactured by Hercules Co.) | 5.0 parts |
| Methyl ethyl ketone/toluene (weight ratio = 1:1) | 80.0 parts |
| Dioxane | 10.0 parts |

The above-described receiving layer transfer sheets were put on a plain paper, and the receiving layer was transferred onto the plain paper by means of a hot roll. Then, the above-described thermal transfer sheet was put on the surface of the receiving layer, and printing was conducted by means of a thermal head under conditions of an output of 1 W/dot, a pulse width of 0.3 to 0.45 msec, a dot density of 3 dots/mm and environmental temperatures of 5° C. and 40° C. to form a cyan image. The quality of the resultant color image is given in Table 3. A change in the thickness of the resin layer when the thermal transfer image-receiving sheet before printing was heated at 120° C. for one min is also given in Table 3.

Further, a coating solution for serving both as a cell-containing layer and an adhesive layer was similarly coated at a coverage on a dry basis of 5 g/m$^2$ and dried to form a layer for serving both as a cell-containing layer and an adhesive layer, thereby providing the receiving layer transfer sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 8 parts |
| Amino-modified silicone (KS-343 manufactured by The Shin-Etsu Chemical Co., Ltd.) | 8 parts |
| Methyl ethyl ketone/toluene (weight ratio = 1:1) | 400 parts |
| **Composition of Coating Solution for Adhesive Layer** | |
| Polymethyl methacrylate resin (BR-106 manufactured by Mitsubishi Rayon Co., Ltd.) | 100 parts |
| Foaming agent (F-30VS manufactured by Matsumoto Yushi Seiyaku Co., Ltd.; | 15 parts |

TABLE 3

| | Sharpness of image | Dropout and omission of dot | Thickness of resin layer (μm) | |
|---|---|---|---|---|
| | | | Before heating | After heating |
| Ex. C1 | Receiving layer was white, and image was sharp. | Neither dropout nor omission occurred. | 10 | 30 |
| Ex. C2 | Receiving layer was white, and image was sharp. | Neither dropout nor omission occurred. | 10 | 15 |
| Ex. C3 | Receiving layer was white, and image was sharp. | Neither dropout nor omission occurred. | 10 | 30 |
| Ex. C4 | Receiving layer was white, and image was sharp. | Neither dropout nor omission occurred. | 10 | 30 |
| Ex. C5 | Receiving layer was white, and image was sharp. | Neither dropout nor omission occurred. | 10 | 25 |
| Comp. Ex. C1 | Receiving layer was white, and image was sharp. | Dropout and omission of dot occurred. | 10 | 25 |
| Comp. Ex. C2 | Receiving layer was white, and image was sharp. | Dropout and omission of dot occurred. | 10 | 10 |

Note 1:
Image-receiving sheets prepared from receiving layer transfer sheets of Comparative Examples C1 and C2 were stored at 50° C. for one month and then examined. As a result, the capsule was broken and no satisfactory cushioning property was attained for the receiving layer, and in the case of Comparative Example 2, no cushioning property was attained also during printing as well.

Thus, according to the present invention, the incorporation of at least two foaming agents different from each other in the foaming temperature can provide a receiving layer transfer sheet and a thermal transfer image-receiving sheet which can form a high-quality and high-density image free from dropout and omission even on a rough paper not having a smooth surface despite a remarkable temperature change during the formation of an image.

EXAMPLE D1

A coating solution having the following composition for a receiving layer was coated on the surface of a 25 μm-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer.

-continued

| | |
|---|---|
| average particle diameter = 5 μm) | |
| Titanium oxide (TCA-888 manufactured by Tohchem Products Corporation) | 100 parts |
| Methyl ethyl ketone/toluene (weight ratio = 1:1) | 300 parts |

EXAMPLE D2

The receiving layer transfer sheet according to the present invention was formed in the same manner as that of Example D1, except that a coating solution having the following composition was used instead of the coating solution for an adhesive.

| Composition of Coating Solution for Adhesive Layer | |
|---|---|
| Polymethyl methacrylate resin (BR-106 manufactured by Mitsubishi Rayon Co., Ltd.) | 100 parts |
| Foaming agent (F-50SS manufactured by Matsumoto Yushi Seiyaku Co., Ltd.; average particle diameter = 8 μm) | 15 parts |
| Methyl ethyl ketone/toluene (weight ratio = 1:1) | 300 parts |

EXAMPLE D3

The receiving transfer layer sheet according to the present invention was formed in the same manner as that of Example D1, except that a coating solution having the following composition was used instead of the coating solution for an adhesive.

| Composition of Coating Solution for Adhesive Layer | |
|---|---|
| Polymethyl methacrylate resin (BR-106 manufactured by Mitsubishi Rayon Co., Ltd.) | 100 parts |
| Foaming agent (F-30GS manufactured by Matsumoto Yushi Seiyaku Co., Ltd.; average particle diameter = 15 μm) | 30 parts |
| Methyl ethyl ketone/toluene (weight ratio = 1:1) | 300 parts |

EXAMPLE D4

A coating solution having the following composition for a receiving layer was coated on the surface of a 25 m-thick polyester film (trade name: Lumirror; a product of Toray Industries, Ltd.) by means of a bar coater so that the coverage on a dry basis was 5.0 g/m$^2$. The coating was preliminarily dried by means of a drier and then dried in an oven of 100° C. for 30 min to form a dye-receiving layer. Further, a coating solution for an intermediate layer was similarly coated on the dye-receiving layer at a coverage on a dry basis of 3 g/m$^2$ and dried to form an intermediate layer, and a coating solution for serving both as a cell-containing layer and an adhesive layer was similarly coated at a coverage on a dry basis of 2 g/m$^2$ and dried to form a layer for serving both as a cell-containing layer and an adhesive layer, thereby providing the receiving layer transfer sheet of the present invention.

| Composition of Coating Solution for Receiving Layer | |
|---|---|
| Vinyl chloride/vinyl acetate copolymer (VYHD manufactured by Union Carbide Corp.) | 100 parts |
| Epoxy-modified silicone (KF-393 manufactured by The Shin-Etsu Chemical Co., Ltd.) | 1 part |
| Amino-modified silicone (KS-343 manufactured by The Shin-Etsu Chemical Co., Ltd.) | 1 part |
| Methyl ethyl ketone/toluene (weight ratio = 1:1) | 500 parts |
| **Composition of Coating Solution for Intermediate Layer** | |
| Polymethyl methacrylate resin (BR-106 manufactured by Mitsubishi Rayon Co., Ltd.) | 100 parts |
| Foaming agent (F-30VS manufactured by Matsumoto Yushi Seiyaku Co., Ltd.; average particle diameter = 15 μm) | 5 parts |
| Methyl ethyl ketone/toluene (weight ratio = 1:1) | 500 parts |
| **Composition of Coating Solution for Adhesive Layer** | |
| Polymethyl methacrylate resin (BR-106 manufactured by Mitsubishi Rayon Co., Ltd.) | 100 parts |
| Foaming agent (F-30VS manufactured by Matsumoto Yushi Seiyaku Co., Ltd.; average particle diameter = 5 μm) | 10 parts |
| Titanium oxide (TCA-888 manufactured by Tohchem Products Corporation) | 100 parts |
| Methyl ethyl ketone/toluene (weight ratio = 1:1) | 500 parts |

EXAMPLE D5

The receiving layer transfer sheet according to the present invention was formed in the same manner as that of Example D1, except that 15 parts of an azodicarbonamide foaming agent (Vinyball AK#2 manufactured by Eiwa Chemical Industrial Co., Ltd.; average particle diameter=3 μm) was incorporated instead of the foaming agent used in Example D1.

Comparative Example D1

A comparative receiving layer transfer sheet was formed in the same manner as that of Example D1, except that use was made of no foaming agent.

Comparative Example D2

A comparative receiving layer transfer sheet was formed in the same manner as that of Example D1, except that Expancel DE (manufactured by Nihon Ferrite K.K.; average particle diameter=50 μm) was used as the foaming agent.

Separately, an ink for a dye layer was prepared according to the following formulation, coated by means of a wire bar on a 6 μm-thick polyethylene terephthalate film having a reverse face subjected to a treatment for rendering the face heat-resistant so that the coverage on a dry basis was 1.0 g/m$^2$, and the resultant coating was dried. Further, several drops of a silicone oil (X-41.40003A manufactured by Shin-Etsu Silicone Co., Ltd.) was dropped on the reverse face by means of a spuit and spread over the whole surface thereof to conduct coating for a reverse face treatment, thereby forming a thermal transfer sheet.

| Composition of Ink for Dye Layer | |
|---|---|
| Disperse dye (Kayaset Blue 714 manufactured by Nippon Kayaku Co., Ltd.) | 4.0 parts |
| Ethylhydroxy cellulose (manufactured by Hercules) | 5.0 parts |
| Methyl ethyl ketone/toluene (weight ratio = 1:1) | 80.0 parts |
| Dioxane | 10.0 parts |

The above-described receiving layer transfer sheets were put on a plain paper, and the receiving layer was transferred onto the plain paper by means of a hot roll. Then, the above-described thermal transfer sheet was put on the surface of the receiving layer, and printing was conducted by means of a thermal head under conditions of an output of 1 W/dot, a pulse width of 0.3 to 0.45 msec, and a dot density of 3 dots/mm to form a cyan image. The quality of the resultant color image is given in Table 4. A change in the thickness of the resin layer when the thermal transfer image-receiving sheet before printing was heated at 120° C. for one min is also given in Table 4.

TABLE 4

| | Variation in density among dots | Dropout and omission of dot | Thickness of resin layer (μm) Before heating | After heating |
|---|---|---|---|---|
| Ex. D1 | Free | Neither dropout nor omission occurred. | 20 | 30 |
| Ex. D2 | Free | Neither dropout nor omission occurred. | 20 | 35 |
| Ex. D3 | Free | Neither dropout nor omission occurred. | 20 | 40 |
| Ex. D4 | Free | Neither dropout nor omission occurred. | 20 | 40 |
| Ex. D5 | Free | Neither dropout nor omission occurred. | 20 | 40 |
| Comp. Ex. D1 | Variation in density occurred due to failure in contact of thermal head. | Dropout and omission of dot occurred. | 20 | 20 |
| Comp. Ex. D2 | Variation in density occurred due to uneven surface of receiving layer. | Dropout and omission of dot occurred. | 20 | 25 |

Thus, according to the present invention, the incorporation of a cell and/or a foaming agent having an average particle diameter of 20 μm or less (in the case of a receiving layer transfer sheet) and 40 μm or less (in the case of a thermal transfer image-receiving sheet) in a cell-containing layer enables a cell-containing layer having an excellent homogeneity, denseness and smoothness to be formed, which contributes to an improvement in the surface smoothness of an dye-receiving layer formed on the cell-containing layer, so that it is possible to provide a receiving layer transfer sheet and a thermal transfer image-receiving sheet which can form a high-quality and high-density image free from dropout and omission of a dot even on a rough paper not having a smooth surface despite a remarkable temperature change during the formation of an image. Further, in the case of a thermal transfer image-receiving sheet, when the foaming agent is already in a foamed state, since the energy applied during the transfer of the dye is less liable to be consumed in the foaming, sufficient cushioning can be attained even when the printing energy is low, so that it becomes possible to form an image having a higher quality.

What is claimed is:

1. A receiving layer transfer sheet comprising a substrate sheet and a transferable resin laminate provided on one surface of said substrate sheet, wherein said transferable resin laminate comprises a dye-receiving layer formed on said substrate sheet and a cell-containing layer formed on said dye-receiving layer, wherein said cell-containing layer contains at least one of a cell and a foaming agent capable of increasing the thickness of said transferable resin laminate by a factor of 1.1 to 4 upon being heated.

2. A receiving layer transfer sheet according to claim 1, wherein the heating is conducted at a temperature in the range of from 90° to 120° C. for one minute.

3. A receiving layer transfer sheet according to claim 1, further comprising an intermediate layer which may contain at least one of a cell and a foaming agent between said dye-receiving layer and said cell-containing layer.

4. A receiving layer transfer sheet according to claim 1, wherein said cell-containing layer serves also as an adhesive layer.

5. A receiving layer transfer sheet according to claim 1, wherein said transferable resin laminate further comprises a white pigment.

6. A thermal transfer image-receiving sheet comprising a substrate sheet and a resin laminate provided on one surface of said substrate sheet, wherein said resin laminate comprises a dye-receiving layer formed on said substrate sheet and a cell-containing layer formed on said dye-receiving layer, wherein said cell-containing layer contains at least one of a cell and a foaming agent capable of increasing the thickness of said resin laminate by a factor of 1.1 to 4 upon being heated.

7. A thermal transfer image-receiving sheet according to claim 6, wherein the heating is conducted at a temperature in the range of from 90° to 120° C. for one minute.

8. A thermal transfer image-receiving sheet according to claim 6, further comprising an intermediate layer which may contain at least one of a cell and a foaming agent between said dye-receiving layer and said cell-containing layer.

9. A thermal transfer image-receiving sheet according to claim 6, wherein said cell-containing layer serves also as an adhesive layer.

10. A thermal transfer image-receiving sheet according to claim 6, wherein said resin laminate further comprises white pigment.

11. A receiving layer transfer sheet comprising a substrate sheet and a transferable resin laminate provided on one surface of said substrate sheet, wherein said transferable resin laminate comprises a dye-receiving layer formed on said substrate sheet and a cell-containing layer formed on said dye-receiving layer, wherein said cell-containing layer comprises at least one of a cell and a foaming agent having an average particle diameter of 20 μm or less.

12. A receiving layer transfer sheet according to claim 11, wherein said forming agent is in a microcapsule form.

13. A receiving layer transfer sheet according to claim 11, further comprising an intermediate layer between said dye-receiving layer and said cell-containing layer.

14. A receiving layer transfer sheet according to claim 11, wherein said cell-containing layer serves also as an adhesive layer.

15. A receiving layer transfer sheet according to claim 11, wherein said transferable resin laminate further comprises a white pigment.

16. A thermal transfer image-receiving sheet comprising a substrate sheet and a resin laminate provided on one surface of said substrate sheet, wherein said resin laminate comprises a dye-receiving layer formed on said substrate sheet and a cell-containing layer formed on said dye-receiving layer, wherein said cell-containing layer comprises at least one of a cell and a foaming agent having an average particle diameter of 40 μm or less.

17. A receiving layer transfer sheet according to claim 16, wherein said forming agent is in a microcapsule form.

18. A receiving layer transfer sheet according to claim 16, further comprises an intermediate layer between said dye-receiving layer and said cell-containing layer.

19. A receiving layer transfer sheet according to claim 16, wherein said cell-containing layer serves also as an adhesive layer.

20. A receiving layer transfer sheet according to claim 16, wherein said resin laminate further comprises a white pigment.

* * * * *